US011578484B2

(12) United States Patent
Grosse

(10) Patent No.: US 11,578,484 B2
(45) Date of Patent: Feb. 14, 2023

(54) WOODEN MODULE

(71) Applicant: Werner Grosse, Stuttgart (DE)

(72) Inventor: Werner Grosse, Stuttgart (DE)

( * ) Notice: Subject to any disclaimer, the term of this patent is extended or adjusted under 35 U.S.C. 154(b) by 326 days.

(21) Appl. No.: 16/982,384

(22) PCT Filed: Mar. 15, 2019

(86) PCT No.: PCT/DE2019/100237

§ 371 (c)(1),
(2) Date: Sep. 18, 2020

(87) PCT Pub. No.: WO2019/179563

PCT Pub. Date: Sep. 26, 2019

(65) Prior Publication Data

US 2021/0002891 A1 Jan. 7, 2021

(30) Foreign Application Priority Data

Mar. 19, 2018 (DE) ..... 102018204154.7

(51) Int. Cl.
*E04C 1/39* (2006.01)
*E04B 2/02* (2006.01)
(Continued)

(52) U.S. Cl.
CPC ..... *E04B 2/32* (2013.01); *E04B 5/08* (2013.01); *E04B 7/00* (2013.01); *E04B 9/00* (2013.01);
(Continued)

(58) Field of Classification Search
CPC .... A63H 33/04; A63H 33/044; A63H 33/086; A63H 33/10; A63H 33/105;
(Continued)

(56) References Cited

U.S. PATENT DOCUMENTS 3,672,681 A * 6/1972 Wolf ..... A63F 9/12 446/119
4,534,563 A * 8/1985 Guenther ..... A63F 9/12 273/157 R
(Continued)

FOREIGN PATENT DOCUMENTS

DE 10 2015 122 919 A1 6/2017
EP 0 158 753 A1 10/1985
FR 992 912 A 10/1951

OTHER PUBLICATIONS

English abstract for DE-10 2015 122 919.

*Primary Examiner* — Jessica L Laux
(74) *Attorney, Agent, or Firm* — Fishman Stewart PLLC

(57) ABSTRACT

A wooden module may include four cross-sectionally square longitudinal pieces of timber, at least six cross-sectionally square transverse pieces of timber, and at least two cross-sectionally square plugs, which may be connected to one another via a plurality of connection plugs. The four longitudinal pieces of timber may be arranged parallel to and spaced apart from one another such that the four longitudinal pieces of timber span a square. The at least six transverse pieces of timber may be arranged over a length of the four longitudinal pieces of timber and may be arranged between the four longitudinal pieces of timber. The at least two plugs may be arranged vertically parallel to one another and to at least four vertical transverse pieces of timber on at least two horizontal transverse pieces of timber and may project from a lateral face of the wooden module.

20 Claims, 2 Drawing Sheets

(51) Int. Cl.

| | |
|---|---|
| ***E04B 2/32*** | (2006.01) |
| ***E04B 5/08*** | (2006.01) |
| ***E04B 7/00*** | (2006.01) |
| ***E04B 9/00*** | (2006.01) |

(52) U.S. Cl.
CPC ..... *E04C 1/39* (2013.01); *E04B 2002/0206* (2013.01); *E04B 2002/0217* (2013.01); *E04B 2002/0245* (2013.01)

(58) Field of Classification Search
CPC .... A63H 33/107; A63H 33/108; A63H 33/12; E04B 1/10; E04B 2002/0243; E04B 2002/0245; E04B 2002/0217; E04B 2002/0215; E04B 2002/0219; E04B 2002/0223; E04B 2002/0206; E04B 2/08; E04B 2/14; E04B 2/02; E04B 2/06; E04C 2/10; E04C 2/12; E04C 2/40; E04C 2/422; E04C 2/46; E04C 2/52; E04C 2003/0495; E04C 3/12; E04C 3/16; E04C 1/24; E04C 1/39
See application file for complete search history.

(56) References Cited

U.S. PATENT DOCUMENTS

| | | | | | |
|---|---|---|---|---|---|
| 5,823,533 | A * | 10/1998 | Edwards | A63F 9/12 | 273/160 |
| 5,868,388 | A * | 2/1999 | Wood | A63F 3/0023 | 273/157 R |
| 5,928,052 | A * | 7/1999 | Buscher | A63H 33/10 | 446/124 |
| 6,648,330 | B2 * | 11/2003 | Porter | A63F 9/12 | 273/156 |
| 10,004,998 | B2 * | 6/2018 | Shih | A63H 33/04 | |

* cited by examiner

WOODEN MODULE

CROSS-REFERENCE TO RELATED APPLICATIONS

This application claims priority to International Patent Application No. PCT/DE2019/100237, filed on Mar. 15, 2019, and German Patent Application No. DE 10 2018 204 154.7, filed on Mar. 19, 2018, the contents of both of which are hereby incorporated by reference in their entirety.

TECHNICAL FIELD

The present invention relates to a wooden module. The invention additionally relates to a wall system having at least five such interconnected wooden modules.

BACKGROUND

Structural engineers and architects have been increasingly focusing in recent years on simple, sustainable, cost-effective and at the same time ecological building. A particularly preferred material used for this purpose is wood, since from an ecological standpoint wood is $CO_2$-neutral and by comparison with, for example, concrete, which for its cement first requires limestone to be quarried, milled and burnt, is energy- and resource-saving and moreover cost-effective. A further advantage of wood-built constructions is the comparatively simple recyclability thereof.

A disadvantage with wood-built constructions known hitherto from the prior art is under certain circumstances their low degree of flexibility where wood is used for example for prefabricated houses. In this case, subsequent plan modifications can be implemented only with great difficulty, if at all. Moreover, it is always also necessary in current wood-built constructions to consider the grain orientation of the wood, since for example a shrinkage tendency of wood orthogonal to the grain orientation is considerably greater than parallel to the grain orientation, which often results in cracks in conventional timber constructions. Moreover, wood also possesses anisotropic compression and tension properties and a wear resistance which is dependent on the grain orientation. A high wear resistance is therefore achieved for example with end-grain wooden floors in which the individual wood grains are arranged orthogonally to the loading surface.

SUMMARY

The present invention is concerned with the problem of avoiding the disadvantages known from the prior art in timber constructions.

This problem is achieved according to the invention by the subject matter of the independent claim(s). Advantageous embodiments form the subject matter of the dependent claim(s).

The present invention is based on the general idea of specifying a wooden module which is not only formed completely from wood but can also be connected to other wooden modules in a comparatively simple manner in a manner of a Lego block and additionally has virtually isotropic properties in terms of strength. From such wooden modules there can then be built walls, pillars, beams, floors, supports, roofs and/or ceilings, to be precise in an extremely flexible manner, with the result that subsequent plan modifications can also be implemented in a comparatively simple manner. Here, the wooden module according to the invention has four cross-sectionally square longitudinal pieces of timber, each with a width $B_1$ and a minimum length $L_1$ of $6B_1$, which are arranged parallel to and spaced apart from one another in such a way that, at their end sides, they span a square with a width $B_2$ of $3B_1$. Between two longitudinal pieces of timber situated on one side of this square there is thus a parallel spacing which in turn corresponds to the width $B_1$. Moreover, the wooden module has at least six cross-sectionally square transverse pieces of timber with a width $B_1$ and a length $L_2$ of $3B_1$. Also provided are at least two cross-sectionally square plugs with a width $B_1$ of a length $L_3$ of $2B_1$. It can already be seen from this enumeration that both the longitudinal pieces of timber and the transverse pieces of timber and the plugs can be produced from a common square timber. In the wooden module according to the invention, at least four transverse pieces of timber are arranged vertically and at least two transverse pieces of timber are arranged horizontally, wherein the transverse pieces of timber are arranged over the length $L_1$ of the longitudinal pieces of timber and between the latter as follows: vertical, horizontal, vertical, vertical, horizontal and vertical. This would thus concern a wooden module having an exact length $L_1$ of $6B_1$. Of course, longer wooden modules can also be produced without problem if longer longitudinal pieces of timber and more transverse pieces of timber or plugs are used. The at least two plugs are arranged vertically parallel to one another and to the vertical transverse pieces of timber on the at least two horizontal transverse pieces of timber and project from a lateral face of the wooden module, similar to a Lego building block, wherein apertures, in which two plugs of another wooden module can be received, are provided opposite the two plugs, that is to say on the opposite side of the at least two horizontal transverse pieces of timber. Here, similarly to Lego building blocks, the wooden module according to the invention can be plugged together to form pillar, wall and ceiling constructions. The individual longitudinal pieces of timber, transverse pieces of timber and plugs of the wooden module are here connected to one another exclusively via connection plugs made of wood, with the result that no further fastening means, such as for example screws, nails or glue, are required. The wooden module according to the invention is thus not a hybrid module, but a module consisting exclusively of wood. A major advantage of the wooden module according to the invention is additionally that it can be manufactured not only from customary square timbers, but also overcomes the intrinsic anisotropic properties of wood since the grain orientation of the longitudinal pieces of timber is oriented transversally with respect to the grain orientation of the transverse pieces of timber and of the plugs, and the vertical transverse pieces of timber and the plugs are oriented transversally with respect to the grain orientation of the longitudinal pieces of timber and of the horizontal transverse pieces of timber. It is thus possible for in particular direction-dependent properties, such as for example a shrinkage tendency and tensile and compressive strength, to be configured identically in all directions. By virtue of the plug connection between the individual longitudinal pieces of timber, transverse pieces of timber and plugs, a fixed connection of these individual components can be achieved, and as a result the achievement of the isotropic, that is to say direction-independent, properties can be supported. Of particular advantage moreover is that the wooden module according to the invention can be configured in different lengths, that is to say also with a different number of transverse pieces of timber and plugs, with the result that door lintels having correspondingly long longitudinal pieces of timber can also be produced without problem. The simple, Lego-like interconnection of the individual wooden modules additionally means that it is possible also for subsequent plan modifications to be implemented in a comparatively simple manner, since all that is then required is for the individual wooden modules to be arranged differently. The mounting of a wall construction from the individual wooden modules is additionally comparatively simple, since all that is required for this purpose is for example a rubber hammer for connection. A further tool is not required. Moreover, flexurally rigid corners can be realized by simple plug connections with the wooden module according to the invention. Here, the production of the bores for the connection plugs can be configured in a fully automated manner corresponding to a predefined grid which is oriented on the width $B_1$. Here, the bores for the individual connection plugs penetrate through the respective longitudinal piece of timber, the respective transverse piece of timber and the plugs orthogonally and cross one another, thereby also making possible a continuous plug connection with correspondingly long connection plugs of for example two parallel longitudinal pieces of timber via a transverse piece of timber arranged therebetween or a plug arranged therebetween.

The transport of the wooden modules to the construction site also proves to be considerably simpler by comparison with wall elements manufactured from wood, since the wooden modules can be delivered to the construction site on pallets in a simple manner and installed there in accordance with the plans. Special trucks and high-powered cranes are not required, with the result that the construction is considerably simplified.

In an advantageous development of the solution according to the invention, two cross-sectionally square filler pieces with a width $B_1$ and a length $L_3$ of $2B_1$ are provided, which are arranged parallel to the longitudinal pieces of timber between two adjacently located transverse pieces of timber. Such filler pieces allow the creation of a completely planar wall surface which in the later course of construction can be covered for example with an insulation or, in interior fitting out, with plasterboard panels.

In a further advantageous embodiment of the solution according to the invention, the minimum length $L_1$ is approximately 48 cm or a multiple thereof. With a length $L_1$ of 48 cm, it is thus possible to create a wooden module according to the invention with four longitudinal pieces of timber, six transverse pieces of timber and two plugs. Of course, a length $L_1$ of 96 cm or even longer is also conceivable, and therefore, with such a wooden module, it is possible for example to realize a door lintel but also ceiling constructions, beam constructions, floors or roofs with a corresponding span without problem.

In an alternative embodiment of the wooden module according to the invention, the latter has four cross-sectionally square longitudinal pieces of timber, with a respective width $B_1$ and a length $L_0$ of $3B_1$, which are arranged parallel to and spaced apart from one another in such a way that, at their end sides, they span a square with a width $B_2$ of $3B_1$. Additionally provided in this considerably shorter wooden module are three cross-sectionally square transverse pieces of timber with a width $B_1$ and a length $L_2$ of $3B_1$, and also a cross-sectionally square plug with a width $B_1$ and a length $L_3=2B_1$. Here, two of the transverse pieces of timber are arranged vertically and one transverse piece of timber is arranged horizontally, wherein the transverse pieces of timber are arranged over the length $L_0$ of the longitudinal pieces of timber and between them as follows: vertical, horizontal, vertical. The single plug in this variant of the wooden module according to the invention is arranged vertically and parallel to the vertical transverse pieces of timber on the horizontal transverse piece of timber and projects from a lateral face of the wooden module, wherein an aperture, which is arranged between the two longitudinal pieces of timber and intended for receiving an adjacent plug, is provided on the opposite side of the horizontal transverse piece of timber. In this wooden module, too, the longitudinal pieces of timber, the transverse pieces of timber and the plug are connected to one another via connection plugs made of wood. The above-described properties with regard to isotropy, resource saving, simple connection technique, flexibility, etc. can here of course also be transposed analogously to this alternative embodiment of the wooden module.

The width $B_1$ of the square timber to be used for the wooden module is expediently approximately 8 cm. In this regard, 8 cm square timbers are commercially standard and can be produced cost-effectively, in particular if they are produced for example from softwood or from weak wood.

In a further advantageous embodiment of the solution according to the invention, the at least one plug is rounded at its end projecting from the lateral face of the wooden module or has bevels. Such a rounding facilitates assembly of a wall or ceiling construction from such wooden modules. Of course, the plug can also have only corresponding bevels at its end projecting from the lateral face that likewise allow the wooden modules to be plugged in a simplified manner.

In a further advantageous embodiment of the solution according to the invention, the connection plugs are formed from hardwood. This achieves a particularly firm and permanent connection of the components of the wooden module, that is to say the longitudinal pieces of timber, the transverse pieces of timber and the plug, wherein a formation of the connection plugs from hardwood additionally offers the major advantage that, on account of their higher strength, they can be driven more simply into associated bores on the longitudinal pieces of timber, the transverse pieces of timber and the plug. Such a connection plug can have for example a diameter of 16 mm, with of course a diameter of the connection plug to be used being dependent on the width $B_1$ of the square timber respectively used for the longitudinal pieces of timber, the transverse pieces of timber and the plugs.

Of course, it is also conceivable that standard square timbers (10×10 cm) are used for the wooden modules and that the plugs have a plug diameter of approximately 20 mm. These dimensions are particularly preferred both in static-constructive terms and for efficiency reasons.

Further important features and advantages of the invention will emerge from the dependent claims, from the drawings and from the associated description of the figures on the basis of the drawings.

It will be understood that the features mentioned above and those still to be explained below can be used not only in the respectively specified combination but also in other combinations or in isolation without departing from the scope of the present invention.

Preferred exemplary embodiments of the invention are illustrated in the drawings and will be explained in more detail in the following description, with identical reference signs referring to identical or similar or functionally identical components.

BRIEF DESCRIPTION OF THE DRAWINGS

In the drawings, in each case schematically

DETAILED DESCRIPTION

In accordance with FIGS. 1 to 6, a wooden module 1 according to the invention has four cross-sectionally square longitudinal pieces of timber 2 with a width $B_1$ which are arranged parallel to and spaced apart from one another in such a way that, at their end sides, they span a square with a width $B_2$ of $3B_1$.

Figure 1:
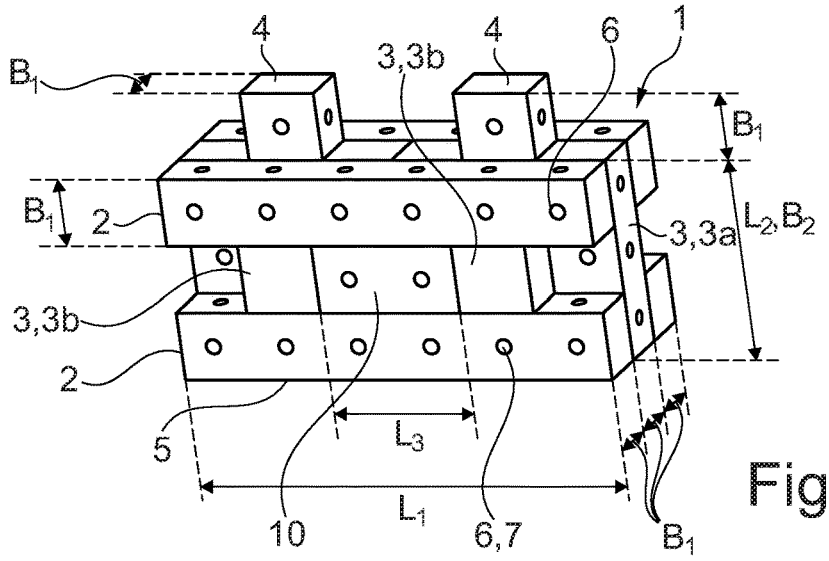
FIG. 1 shows a view of a wooden module according to the invention according to a first embodiment.

According to FIG. 1, the wooden module 1 according to the invention depicted there has six cross-sectionally likewise square transverse pieces of timber 3 with a width $B_1$ and a length $L_2=3B_1$. Likewise, the wooden module 1 illustrated according to FIG. 1 has two cross-sectionally square plugs 4 with a width $B_1$ and a length $L_3$ of $2B_1$. Here, four of the transverse pieces of timber 3 are arranged vertically and designated by the reference sign 3*a*, whereas two transverse pieces of timber 3 are arranged horizontally and are provided with the reference sign 3*b*. Here, the transverse pieces of timber 3, 3*a* and 3*b* are arranged over the length $L_1$ of the longitudinal pieces of timber 2 and between them as follows: vertical, horizontal, vertical, vertical, horizontal and vertical. The two plugs 4 are arranged vertically and parallel to one another and also parallel to the vertical transverse pieces of timber 3*a* on the at least two horizontal transverse pieces of timber 3*b* and project from a lateral face of the wooden module 1. On the underside of the wooden module 1 (cf. in particular FIG. 5) in the region of the opposite plug 4 there is arranged an aperture 5 for receiving a plug 4 of an adjacent wooden module 1. Here, the longitudinal pieces of timber 2, the transverse pieces of timber 3, 3*a*, 3*b* and the plugs 4 are pinned together via connection plugs 6 and thereby held fixedly on one another. Further fastening means, such as for example screws, nails or glue, are not used.

Figure 2:
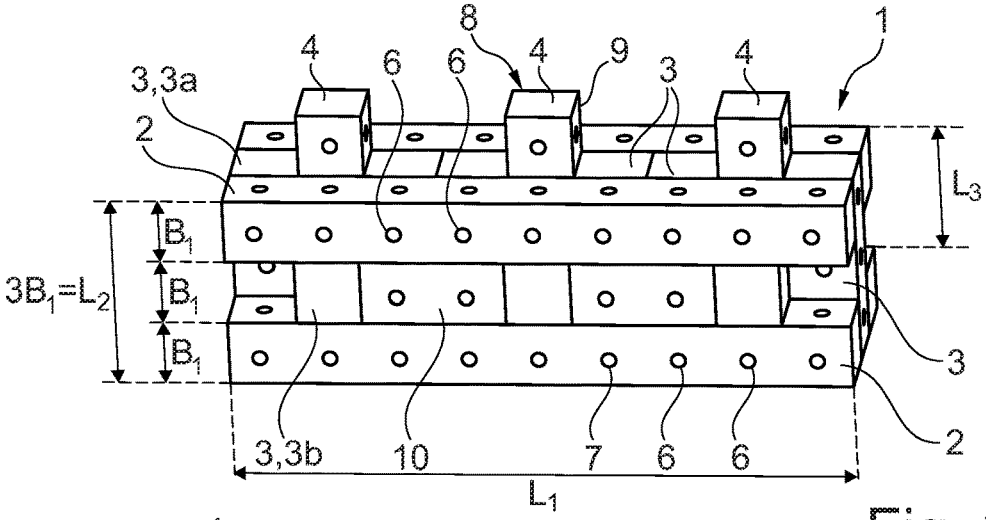
FIG. 2 shows an illustration as in FIG. 1, but according to a second embodiment.

With consideration to the wooden module 1 according to the invention as shown in FIG. 2, the longitudinal pieces of timber 2 thereof are considerably longer, and therefore nine transverse pieces of timber 3 in total are arranged. According to FIG. 2, the transverse pieces of timber 3 are here arranged over the length $L_1$ of the longitudinal pieces of timber 2 as follows: vertical, horizontal, vertical, vertical, horizontal, vertical, vertical, horizontal and vertical.

Figure 3:
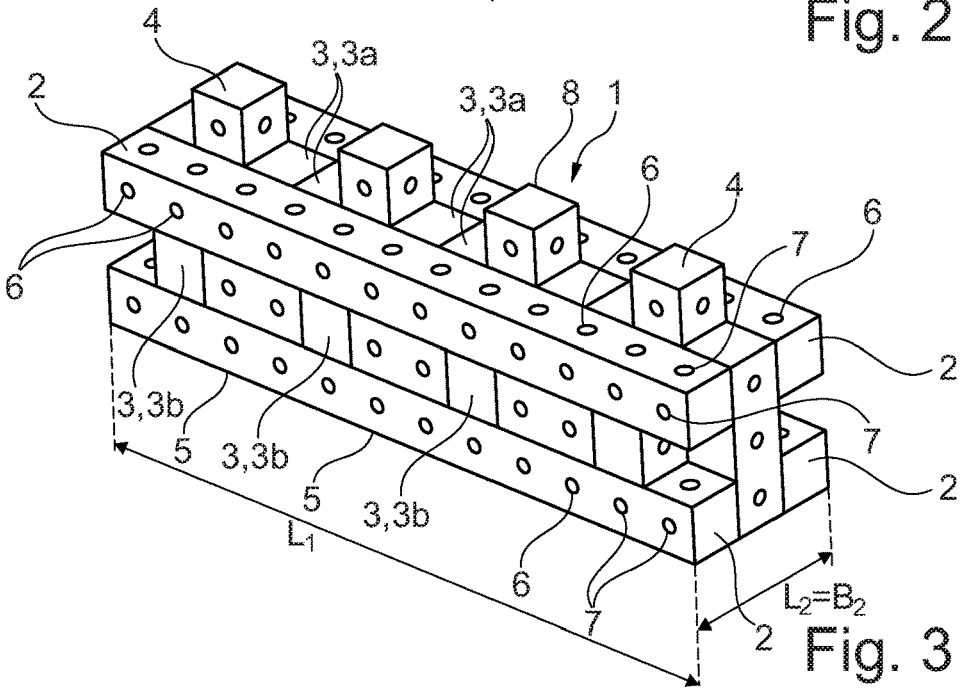
FIG. 3 shows an illustration as in FIG. 2, but in a longer embodiment.

A wooden module 1 which is even longer in terms of its length $L_1$ is illustrated according to FIG. 3.

Figure 4:
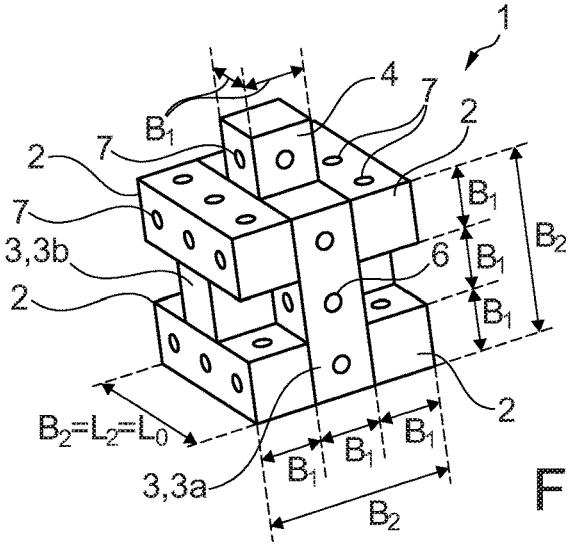
FIG. 4 shows an illustration as in FIG. 1, but in a shorter embodiment.

The wooden module 1 according to the invention illustrated in FIG. 4 has four cross-sectionally square longitudinal pieces of timber 2 with in each case a width $B_1$ and a length $L_0$ of $3B_1$, wherein the longitudinal pieces of timber 2 are arranged parallel and spaced apart from one another in such a way that, at their end sides, they likewise span a square with a width $B_2$ of $3B_1$. In this special case, the length $L_0$ of the longitudinal pieces of timber 2 corresponds to the length $L_2$ of the transverse pieces of timber 3 and the width $B_2$ of the spanned end-side or lateral square. The wooden module 1 illustrated according to FIG. 4 has three cross-sectionally square transverse pieces of timber with a width $B_1$ and a length $L_2=3B_1$ and a cross-sectionally square plug 4 with a width $B_1$ and a length $L_3$ of $2B_1$. Here, two transverse pieces of timber 3*a* are arranged vertically, whereas one transverse piece of timber 3*b* is arranged horizontally. Here, the transverse pieces of timber 3, 3*a*, 3*b* are arranged over the length $L_0$ of the longitudinal pieces of timber 2 and between them as follows: vertical, horizontal, vertical. The plug 4 in turn is arranged vertically and parallel to the vertical transverse pieces of timber 3*a* on the horizontal transverse piece of timber 3*b* and projects from a lateral face of the wooden module 1, wherein, in this case too, the longitudinal pieces of timber 2, the transverse pieces of timber 3*a*, 3*b*, 3 and the plug 4 are connected to one another via connection plugs 6 made of wood.

Regardless of the chosen embodiment of the wooden module 1 according to the invention, bores 7 are incorporated in the longitudinal pieces of timber 2, the transverse pieces of timber 3 and the plugs 4 for the connection plugs 6, specifically with a predefined grid spacing which customarily corresponds to the width $B_1$. The width $B_1$ can be 8 cm for example, with it always applying for the wooden module 1 according to the invention, regardless of its size, that said module has isotropic properties, that is to say direction-independent properties, in particular with respect to shrinkage and compressive and tensile strength, as a result of the plugs 4 arranged orthogonally to the horizontal transverse members 3*b* and the longitudinal pieces of timber 2 and as a result of the vertical transverse pieces of timber 3*a* arranged orthogonally to the longitudinal pieces of timber 2. This is of immense advantage particularly in wooden modules 1 since they have a higher shrinkage tendency and a considerably lower tensile strength transversally to a wood grain orientation than along the respective wood grain orientation.

Figure 6:
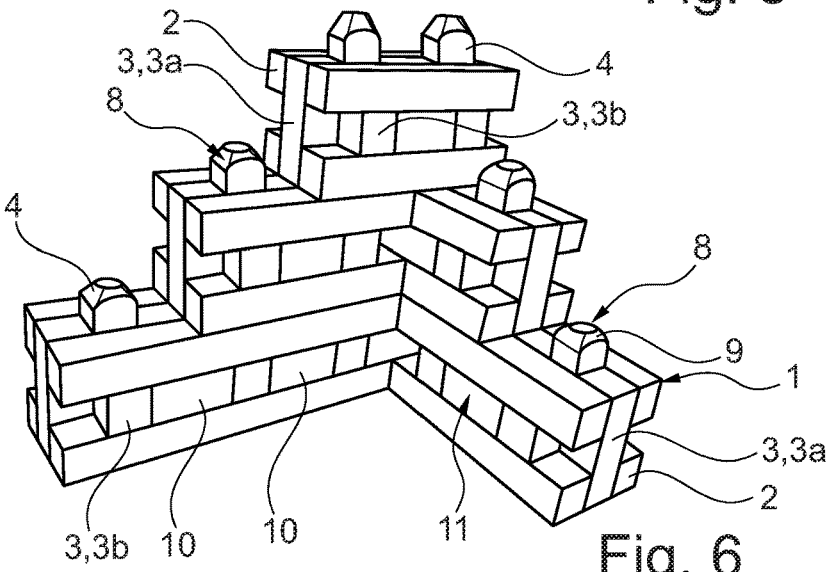
FIG. 6 shows a flexurally rigid corner produced from the wooden modules according to the invention.

If consideration is given to the plugs 4 according to FIG. 6, it can be seen that they are rounded at their end 8 projecting from the lateral face of the wooden module 1 or have bevels 9. This particularly allows simplified plugging together of the wooden modules 1, particularly even with only a rubber hammer.

The connection plugs 6 are customarily formed from hardwood, with the result that a particularly firm connection of the individual components, that is to say the longitudinal pieces of timber 2, the transverse pieces of timber 3 and the plugs 4, can be achieved. The longitudinal members 2, the transverse members 3, 3*a* and 3*b* and/or the plugs 4 and cross-sectionally square filler pieces 10 (cf. FIGS. 1 to 3) can here by formed from softwood or from weak wood and thus produced cost-effectively. The bores 7 to be provided for the connection plugs 6 are incorporated in the longitudinal pieces of timber 2, the transverse pieces of timber 3 and the plugs 4 or the filler pieces 10 crosswise, that is to say crossing one another in the above-defined grid spacing. This can occur with automated drilling operations. The use of weak wood or softwood for the square timbers for the longitudinal members 2, the transverse members 3 and the plugs 4 or the filler pieces 10 allows them to be produced in a particularly cost-effective manner.

Figure 5:
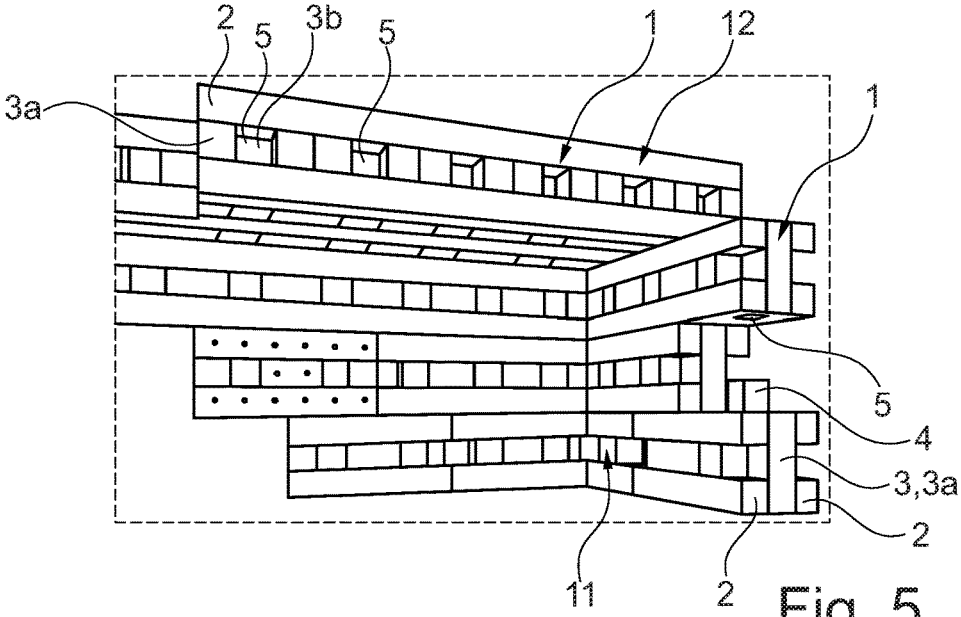
FIG. 5 shows a wall and ceiling system, produced from the wooden modules according to the invention.

According to FIGS. 5 and 6 there are here shown wall systems 11 or ceiling systems 12 produced from individual wooden modules 1, wherein, particularly for the ceiling systems 12, use is made of wooden modules 1 having a larger length $L_1$ to be able to achieve a larger span. Here, the wooden modules 1 which are longer in terms of their length $L_1$ can also be used without problem as door lintels. The filler pieces 10 allow the lateral faces of the wooden module 1 to have a planar configuration. However, beam systems, pillar systems, floors, supports or roof systems can of course also be produced with the wooden modules 1.

The wooden modules 1 according to the invention allow comparatively simple, resource-saving and ecological building even over a number of stories, with only a hammer or rubber hammer being required for the mounting operation. The omission of conventional connection means, such as for example screws, glue or nails, makes it possible to achieve improved recyclability of the wooden modules 1 according to the invention. A further advantage of the wooden modules is their destruction-free recyclability, with the result that they can be reused for new constructions. Particular emphasis should also be placed on an extremely high flexibility, with the result that subsequent plan modifications can be implemented in a comparatively simple and flexible manner with the wooden module 1 according to the invention, something which was not possible hitherto with ready-made components prefabricated in halls. The orthogonal arrangement of the longitudinal pieces of timber 2, the transverse pieces of timber 3*a*, 3*b* and the plugs 4 makes it possible to achieve in particular isotropic shrinkage properties and tensile and compressive strengths, something which was not possible with hitherto unidirectional processed timbers. It is also conceivable to deliver the wooden modules 1 to a construction site without relatively large mobile cranes, that is to say simply in pallet form.

The invention claimed is:

1. A wooden module, comprising:

four cross-sectionally square longitudinal pieces of timber with a width $B_1$ and a minimum length $L_1=6B_1$, the four longitudinal pieces of timber arranged parallel to and spaced apart from one another such that, at respective end sides of the four longitudinal pieces of timber, the four longitudinal pieces of timber span a square with a width $B_2=3B_1$;

at least six cross-sectionally square transverse pieces of timber with a width $B_1$ and a length $L_2=3B_1$;

at least two cross-sectionally square plugs with a width $B_1$ and a length $L_3=2B_1$;

wherein at least four vertical transverse pieces of timber of the at least six transverse pieces of timber are arranged vertically and at least two horizontal transverse pieces of timber of the at least six transverse pieces of timber are arranged horizontally;

wherein the at least six transverse pieces of timber are arranged between the four longitudinal pieces of timber and sequentially along the length $L_1$ of the four longitudinal pieces of timber as follows: vertical, horizontal, vertical, vertical, horizontal, vertical;

wherein the at least two plugs are arranged vertically parallel to one another and to the at least four vertical transverse pieces of timber on the at least two horizontal transverse pieces of timber and project from a lateral face of the wooden module; and wherein the four longitudinal pieces of timber, the at least six transverse pieces of timber, and the at least two plugs are connected to one another via a plurality of connection plugs composed of wood.

2. The wooden module as claimed in claim 1, further comprising two cross-sectionally square filler pieces with a width $B_1$ and a length $L_3=2B_1$, wherein the two filler pieces are arranged parallel to the four longitudinal pieces of timber between two adjacent horizontal transverse pieces of timber of the at least two horizontal transverse pieces of timber.

3. The wooden module as claimed in claim 2, wherein the width $B_1$ is approximately 8 cm.

4. The wooden module as claimed in claim 3, wherein the length $L_1$ is approximately 48 cm.

5. The wooden module as claimed in claim 4, wherein the plurality of connection plugs have a diameter of approximately 16 mm.

6. The wooden module as claimed in claim 1, wherein the width $B_1$ is approximately 8 cm.

7. The wooden module as claimed in claim 1, wherein the length $L_1$ is at least one of (i) approximately 48 cm and (ii) a multiple of 48 cm.

8. A wooden module, comprising:

four cross-sectionally square longitudinal pieces of timber with a width $B_1$ and a length $L_0=3B_1$, the four longitudinal pieces of timber arranged parallel to and spaced apart from one another such that, at respective end sides of the four longitudinal pieces of timber, the four longitudinal pieces of timber span a square with a width $B_2=3B_1$;

three cross-sectionally square transverse pieces of timber with a width $B_1$ and a length $L_2=3B_1$;

a cross-sectionally square plug with a width $B_1$ and a length $L_3=2B_1$;

wherein two vertical transverse pieces of timber of the three transverse pieces of timber are arranged vertically and one horizontal transverse piece of timber of the three transverse pieces of timber is arranged horizontally;

wherein the three transverse pieces of timber are arranged between the four longitudinal pieces of timber and sequentially along the length $L_0$ of the four longitudinal pieces of timber as follows: vertical, horizontal, vertical;

wherein the plug is arranged vertically and parallel to the two vertical transverse pieces of timber on the one horizontal transverse piece of timber and projects from a lateral face of the wooden module; and wherein the four longitudinal pieces of timber, the three transverse pieces of timber, and the plug are connected to one another via a plurality of connection plugs composed of wood.

9. The wooden module as claimed in claim 8, wherein the plug at least one of (i) is rounded and (ii) has a plurality of bevels, at an end projecting from the lateral face of the wooden module.

10. The wooden module as claimed in claim 8, wherein the plurality of connection plugs are composed of hardwood.

11. The wooden module as claimed in claim 8, wherein at least one of:

at least one of the four longitudinal pieces of timber, the three transverse pieces of timber, and the plug is composed of softwood; and at least one of the four longitudinal pieces of timber, the three transverse pieces of timber, and the plug is composed of weak wood.

12. The wooden module as claimed in claim 8, wherein the plurality of connection plugs have a diameter of approximately 16 mm and are received in a plurality of bores disposed in at least one of the four longitudinal pieces of timber, the three transverse pieces of timber, and the plug.

13. A wall system, a ceiling system, a beam system, a pillar system, a floor system, a support system, and/or a roof system, comprising at least five wooden modules as claimed in claim 1 that are at least one of interconnected and plugged-together.

14. The wooden module as claimed in claim 1, wherein an end of each of the at least two plugs that projects from the lateral face of the wooden module is rounded.

15. The wooden module as claimed in claim 1, wherein an end of each of the at least two plugs that projects from the lateral face of the wooden module includes a plurality of bevels.

16. The wooden module as claimed in claim 1, wherein the plurality of connection plugs are composed of hardwood.

17. The wooden module as claimed in claim 1, wherein at least one of the four longitudinal pieces of timber, the at least six transverse pieces of timber, and the at least two plugs is composed of softwood.

18. The wooden module as claimed in claim 1, wherein at least one of the four longitudinal pieces of timber, the at least six transverse pieces of timber, and the at least two plugs is composed of weak wood.

19. The wooden module as claimed in claim 1, wherein the plurality of connection plugs have a diameter of approximately 16 mm.

20. The wooden module as claimed in claim 1, wherein the plurality of connection plugs are received in a plurality of bores disposed in at least one of the four longitudinal pieces of timber, the at least six transverse pieces of timber, and the at least two plugs.

* * * * *